US009692118B2

(12) United States Patent
Seo et al.

(10) Patent No.: US 9,692,118 B2
(45) Date of Patent: Jun. 27, 2017

(54) ANTENNA AND PORTABLE DEVICE HAVING THE SAME

(71) Applicant: Samsung Electronics Co., Ltd., Gyeonggi-do (KR)

(72) Inventors: Jaemin Seo, Gyeonggi-do (KR); Jaesun Park, Gyeonggi-do (KR); Wailing Lee, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 246 days.

(21) Appl. No.: 14/156,618

(22) Filed: Jan. 16, 2014

(65) Prior Publication Data

US 2014/0203982 A1 Jul. 24, 2014

(30) Foreign Application Priority Data

Jan. 23, 2013 (KR) ..... 10-2013-0007232

(51) Int. Cl.

| | |
|---|---|
| ***H01Q 1/24*** | (2006.01) |
| ***H01Q 1/52*** | (2006.01) |
| ***H01Q 9/42*** | (2006.01) |
| ***H01Q 21/28*** | (2006.01) |
| ***H01Q 5/314*** | (2015.01) |

(52) U.S. Cl.

CPC ..... *H01Q 1/523* (2013.01); *H01Q 1/243* (2013.01); *H01Q 1/521* (2013.01); *H01Q 5/314* (2015.01); *H01Q 9/42* (2013.01); *H01Q 21/28* (2013.01)

(58) Field of Classification Search

CPC ..... H01Q 1/52; H01Q 1/521; H01Q 1/523; H01Q 21/28; H01Q 1/241; H01Q 1/242; H01Q 1/243; H01Q 5/30; H01Q 5/307; H01Q 5/314; H01Q 5/321; H01Q 5/35; H01Q 5/50; H01Q 1/22; H01Q 1/2258; H01Q 1/2266; H01Q 1/24; H01Q 1/44; H01Q 1/48; H01Q 5/328; H01Q 5/335; H01Q 5/40; H01Q 5/45; H01Q 7/005

USPC ..... 343/702

See application file for complete search history.

(56) References Cited

U.S. PATENT DOCUMENTS

| | | | | |
|---|---|---|---|---|
| 6,097,339 A * | 8/2000 | Filipovic | ..... | H01Q 1/243 343/700 MS |
| 6,483,463 B2 * | 11/2002 | Kadambi | ..... | H01Q 9/0421 343/700 MS |
| 7,450,072 B2 * | 11/2008 | Kim | ..... | H01Q 1/243 343/700 MS |

(Continued)

FOREIGN PATENT DOCUMENTS

| | | |
|---|---|---|
| EP | 2 048 739 A1 | 4/2009 |
| EP | 2 328 233 A2 | 6/2011 |

(Continued)

*Primary Examiner* — Sue A Purvis
*Assistant Examiner* — Patrick Holecek
(74) *Attorney, Agent, or Firm* — Cha & Reiter, LLC

(57) ABSTRACT

An antenna apparatus and a portable device having the same are provided. The antenna apparatus includes a main antenna having a first radiator pattern, and an auxiliary antenna separated from the main antenna by a metal surface adjacent to the main antenna. The auxiliary antenna is resonant at a resonant frequency which is a function of at least one capacitor provided in a cut-out area of a printed circuit board (PCB) adjacent to the metal surface.

10 Claims, 10 Drawing Sheets

(56) References Cited

U.S. PATENT DOCUMENTS

| | | | | |
|---|---|---|---|---|
| 7,760,146 | B2 * | 7/2010 | Ollikainen | H01Q 1/243 343/702 |
| 7,884,774 | B2 * | 2/2011 | Huang | H01Q 1/243 343/700 MS |
| 8,068,058 | B2 * | 11/2011 | Sullivan | H01Q 1/243 343/700 MS |
| 8,581,799 | B2 * | 11/2013 | Choi | H01Q 1/243 343/845 |
| 8,648,763 | B2 * | 2/2014 | Choi | H01Q 1/48 343/845 |
| 9,166,279 | B2 * | 10/2015 | Jin | H01Q 1/243 |
| 2010/0097282 | A1 | 4/2010 | Chirila | |
| 2010/0304785 | A1 | 12/2010 | Marlett et al. | |
| 2011/0210898 | A1 * | 9/2011 | Choi | H01Q 1/243 343/749 |
| 2012/0229347 | A1 | 9/2012 | Jin et al. | |
| 2013/0076580 | A1 * | 3/2013 | Zhang | H01Q 1/243 343/720 |
| 2013/0241796 | A1 * | 9/2013 | Nagumo | H01Q 1/243 343/861 |

FOREIGN PATENT DOCUMENTS

| | | | |
|---|---|---|---|
| EP | 2 498 336 | A2 | 9/2012 |
| KR | 10-2012-0102516 | A | 9/2012 |
| WO | 2011/158057 | A1 | 12/2011 |
| WO | 2012/066838 | A1 | 5/2012 |

* cited by examiner

ANTENNA AND PORTABLE DEVICE HAVING THE SAME

CLAIM OF PRIORITY

This application claims the benefit under 35 U.S.C. §119 (a) of a Korean patent application filed on Jan. 23, 2013 in the Korean Intellectual Property Office and assigned Serial No. 10-2013-0007232, the entire disclosure of which is hereby incorporated by reference.

BACKGROUND

Technical Field

The present disclosure relates generally to an antenna and a portable device having the same, and more particularly, to a multi-band antenna configured for disposition in a limited space structure of the portable device.

Description of the Related Art

In general, a portable device is an electronic device in which a user can perform wireless communication with another party while hand-held. Recent portable devices have advanced to configurations which are small, thin, and light-weight in consideration of portability, along with advances in multimedia that can perform various functions.

Particularly, there is a need to provision capability for multi-band communication in today's portable devices, to transmit/receive RF signals of various types and protocols, e.g., various multimedia environments and Internet environments, while maintaining a small size and light weight. Multi-band capability is needed for communication of high speed data signals in addition to a traditional telephony function.

A typical portable device includes a data input and output device, a speaker, a microphone, and an antenna, among other electronics. Recent designs employ an internal antenna rather than an external antenna, for convenience and reliability. Conventionally, because a telephony dedicated communication antenna and a data communication antenna were shared, even if one antenna radiator was used, the packaging problem was not a severe one. However, as multimedia related data communication increases, it is difficult to provide a multiple service with one telephony dedicated communication antenna, and thus a data communication exclusive antenna is needed. Further, as a communication method develops from a presently widely used 3G communication method to a 4G Long Term Evolution (LTE) communication method, a 4G communication antenna is separately added and thus the number of antennas mounted in the portable device increases. Thereby, antenna allocation space for each antenna in the portable device is reduced. As such, it is difficult to package multiple antennas in the constrained space within the portable device.

Accordingly, due to the ongoing desire for small, light-weight and thin portable devices with high functionality, there is a need for an antenna meeting requisite performance in as small of an internal space within the portable device as possible.

SUMMARY

The present disclosure provides embodiments of an antenna apparatus and a portable device having the same, which have multiple antennas within the portable device operable at different bands and are capable of preventing a distortion phenomenon of an antenna characteristic due to interference between antennas.

In an embodiment, an antenna apparatus in a portable device includes a main antenna having a first radiator pattern, and an auxiliary antenna separated from the main antenna by a metal surface adjacent to the main antenna. The auxiliary antenna is resonant at a resonant frequency which is a function of at least one capacitor provided in a cut-out area of a printed circuit board (PCB) adjacent to the metal surface.

In an embodiment, a portable device with an antenna apparatus includes a PCB having first and second cut-out areas formed adjacent to an uppermost level metal layer, and at least one lower metal layer separated from the uppermost layer by a dielectric layer. A main antenna is disposed at the first cut-out area, and has a first radiator configured for operation at a first resonant frequency. An auxiliary antenna includes at least one capacitor, the auxiliary antenna is disposed at the second cut-out area, and is configured to resonate at a second resonant frequency which is a function of the at least one capacitor. The auxiliary antenna radiates through a ground surface at a periphery of the second cut-out area.

In an embodiment, an antenna apparatus provided in a portable device includes a main antenna that radiates an RF (radio frequency) signal supplied from a PCB, the RF signal being transferred between the PCB and a metal pattern radiator of the main antenna disposed on a first side of the PCB. At least one capacitor is connected on one side thereof to a ground surface that at least partially encloses a second cut-out area formed in a partial area of the PCB on an opposite side of the PCB. An auxiliary antenna is supplied an RF signal from the PCB through an RF feed point, transfers the signal to the capacitor, and transmits and receives an RF wave through a path returning to a ground surface of the PCB via the at least one capacitor. The auxiliary antenna transmits and receives an RF wave of a resonant frequency band which is a function of the capacitor.

BRIEF DESCRIPTION OF THE DRAWINGS

The above aspects, features and advantages of the present disclosure will be more apparent from the following detailed description in conjunction with the accompanying drawings, in which.

DETAILED DESCRIPTION

Figure 1:
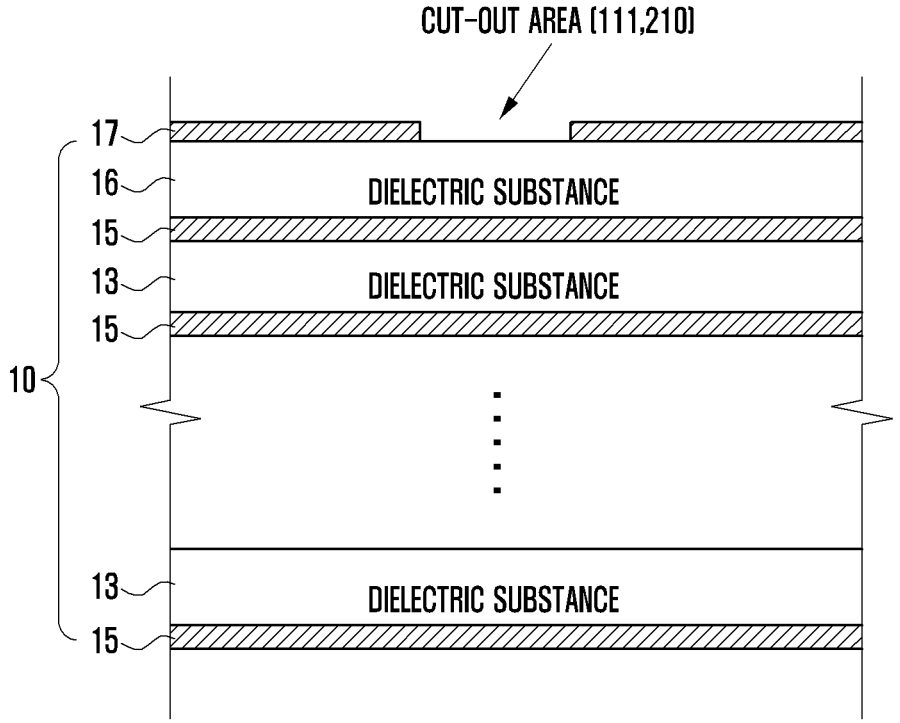
FIG. 1 is a cross-sectional view illustrating a PCB for forming or mounting an antenna according to an exemplary embodiment of the present disclosure.

Hereinafter, exemplary embodiments of the present disclosure are described in detail with reference to the accompanying drawings. The same reference numbers are used throughout the drawings to refer to the same or like parts. The views in the drawings are schematic views only, and are not intended to be to scale or correctly proportioned. Detailed descriptions of well-known functions and structures incorporated herein may be omitted to avoid obscuring the subject matter of the present disclosure.

In an exemplary embodiment of the present disclosure, a portable device can be any of a variety of information, communication devices and multimedia devices such as a smart phone, a tablet personal computer (PC), a mobile communication terminal, mobile phone, a personal digital assistant (PDA), an international mobile telecommunication 2000 (IMT-2000) terminal, a code division multiple access (CDMA) terminal, a wideband code division multiple access (WCDMA) terminal, a global system for mobile communication (GSM) terminal, a general packet radio service (GPRS) terminal, an enhanced data GSM environment (EDGE) terminal, a universal mobile telecommunication service (UMTS) terminal, a digital broadcasting terminal, and an automated teller machine (ATM).

Figure 2:
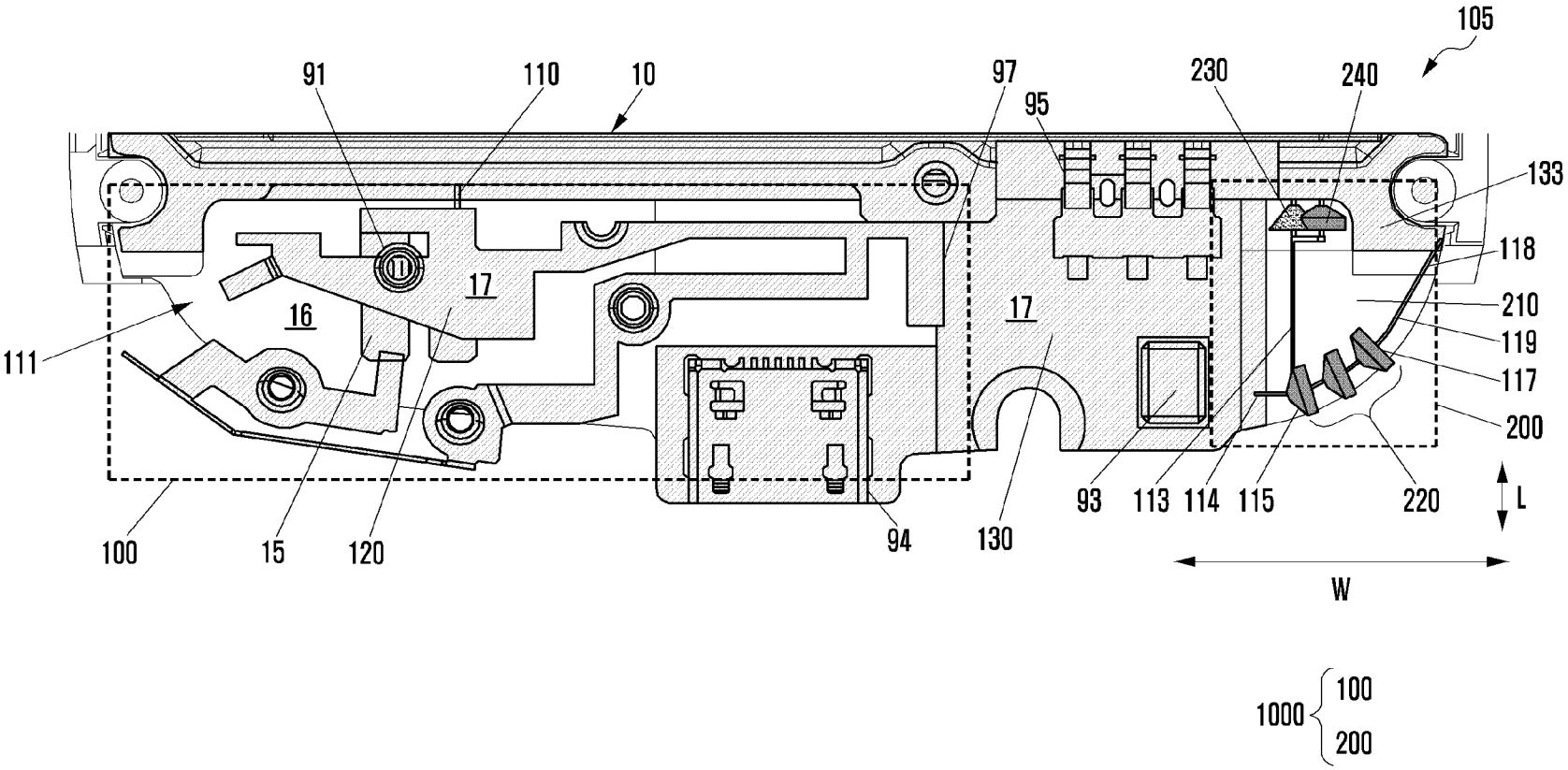
FIG. 2 is a plan view illustrating a structure of an antenna apparatus according to an exemplary embodiment of the present disclosure.

FIG. 1 is a cross-sectional view illustrating a printed circuit board (PCB) for forming or mounting an antenna apparatus according to an exemplary embodiment of the present disclosure, and FIG. 2 is a plan view illustrating a structure of an example antenna apparatus according to an exemplary embodiment of the present disclosure.

Referring to FIGS. 1 and 2, a portable device 105 according to the present exemplary embodiment includes an antenna apparatus 1000 comprised of a main (first) antenna 100 and an auxiliary (second) antenna 200.

The main antenna 100 and the auxiliary antenna 200 have different configuration types and may have different principles of radiation. Antennas 100 and 200 may be disposed in a lower end portion of a printed circuit board (PCB) provided within the portable device. For example, the antennas 100, 200 may be laterally offset in a width direction W of the portable device, as shown in FIG. 2.

The PCB 10 may be a multi-layer board, i.e., a board of a stacked structure in which a dielectric layer 13 and a metal plating layer 15 are alternately stacked in a repetitive fashion, as shown in FIG. 1. Dielectric layer 16 is directly below uppermost plating layer 17. An area in which a portion of an uppermost level metal plating layer 17 of the PCB 10 is removed is referred to as a cut-out area. Areas 111 and 210 in FIG. 2 are example cut-out areas.

The main antenna 100 is formed in the vicinity of such a cut-out area 111 to prevent radiating gain efficiency from deteriorating by a peripheral metal body. The cut-out spaces of the cut-out area provide separation between the conductive material of the antenna and neighboring metal of other components. As the metal plating layer, a metal material such as gold, silver, copper, nickel, and aluminum may be used, but from a cost viewpoint, copper is preferable.

The auxiliary antenna 200 is adjacent to the main antenna 100 in a lateral direction and is disposed in the cut-out area 210 formed on a portion of the uppermost level metal plating layer. In this example, main antenna 100 and the auxiliary antenna 200 are separated by a metal surface 130.

The metal surface 130 is an uppermost level metal plating layer of the PCB, and is referred to as an area other than the cut-out area 111 of the main antenna 100 and the cut-out area 210 of the auxiliary antenna 200. Metal surface 130 functions as a ground surface of the main antenna 100 and the auxiliary antenna 200. In the example, a right-most portion 97 of antenna 100 is electrically connected to a side of surface 130 so as to provide a shunt reactance for tuning to achieve a desired resonance. (Although a solid line is shown separating the portion 97 of antenna 100 and the side of surface 130, the surface 130 may be continuous with the portion 97.)

The main antenna 100 transmits and receives radio frequency (RF) waves (e.g., UHF or microwave) through a metal pattern in which power is supplied. Hereinafter, the metal pattern is referred to as a radiator pattern or just "radiator".

An RF signal is transferred from an RF circuit (not shown) of PCB 10 to radiator 120 through a power supply connection 110, and is transmitted as an electromagnetic wave from device 105 as a result of the resonance properties of antenna 100. A resonant frequency of the main antenna 100 is a function of an entire length of the radiator pattern 120, a horizontal length and a vertical length of the radiator pattern 120, and a dielectric constant of the PCB.

For example, as a length of the radiator pattern 120 is shortened, a resonant frequency of an antenna may be changed to a higher frequency, and as a length of the radiator pattern 120 is extended, a resonant frequency of an antenna may be changed to a lower frequency.

For example, the main antenna 100 may be formed as a planar inverted-F antenna (PIFA). The PIFA antenna is an antenna having a planar radiator element, as in a thin metal plate, and also having a radiator portion which is returned to PCB through a grounded portion, for the purpose of matching, thereby forming a structure resembling an inverted letter "F" (as seen at the right side portion 95).

The main antenna 100 may be alternatively or additionally be an antenna formed by etching an antenna circuit to the PCB 10, an antenna radiating through a radiator formed in a Z-axis direction of the PCB 10 (up-down direction in FIG. 1 and direction through the paper in FIG. 2) by a connection of the PCB layer of a stacked structure and a via hole 91, an antenna formed in a carrier by metal pattern plating, an antenna generated by rear fusion-bonding, an antenna formed using a flexible PCB (FPCB), laser direct structuring (LDS) antenna, and/or an antenna generated by an injection process of some other type. In the example of FIG. 2, a via hole connection 91 connects top layer metal (composed of by uppermost layer 17 metal) with a lower layer metal 15, thereby extending a radiator length of radiator pattern 120.

The main antenna 100 may be at least one of an antenna having a frequency band of 1.56 GHz or more for Bluetooth (BT), a global positioning system (GPS), and WiFi and an antenna that performs communication of global system for mobile communication (GSM), code division multiple access (CDMA), and wideband code division multiple access (WCDMA).

The auxiliary antenna 200 employs at least one physical capacitor in a loop back structure, and thereby has a different structure and radiation principle than those of main antenna 100. In particular, auxiliary antenna 200 is formed within the cut-out area 210 of the uppermost level metal plating layer 17 of the PCB 10, and has a portion which connects to a ground surface 133 at a periphery of the cut-out area 210. In the cut-out area 210, at least one capacitor 220, e.g., a chip capacitor, is provided.

The auxiliary antenna 200 transmits an RF signal provided from an RF transmitter (not shown) through a transmission line of PCB 10, and when receiving an external signal, provides the receive signal to an RF receiver of PCB 10. Antenna 200 is fed from PCB 10 at a feed connector 230 (interchangeably called "RF feed point" or "power supply connector" or the like). On transmit, an RF signal supplied from the PCB 10 is transferred to a capacitor 220 through the feed connector 230, where the capacitor 220 is connected on another side (terminal or plate) thereof to the ground surface 133, thereby being part of a return path to achieve resonance at a desired frequency. (Note that capacitor 220 is exemplified in FIG. 2 as comprising three capacitors connected in series.) Auxiliary antenna 200 thereby has a driving characteristic that transmits and receives an electromagnetic wave at a resonant frequency band determined by the capacitance and physical structure of capacitor 220.

Particularly, the auxiliary antenna 200 of the present exemplary embodiment is disposed at a location separated by a predetermined distance from the main antenna 100 by the metal surface 130. Because radiation principles of the two antennas 100 and 200 are different, mutual interference between the two antennas 100 and 200 can be minimized.

That is, the main antenna 100 transmits and receives an electromagnetic wave through the radiator pattern 120 and has a resonant frequency determined by a length of the radiator pattern 120. On the other hand, auxiliary antenna 200 transmits and receives an electromagnetic wave through the ground surface 133 that encloses the cut-out area 210, and has a resonant frequency which is a function of the capacitance of at least one capacitor 220 provided in the cut-out area 210.

"Capacitor 220 may receive power from the power supply connector 230 of the PCB at one side 117 (via current flow through ground surface 133), and the other side 115 thereof is connected to the ground surface 130 as illustrated. In an alternative embodiment the other side 117 may be selectively connected to the ground surface 133. That is, an optional switching circuit (not shown) may be included to selectively make a connection between the other side 117 of capacitor 220 and the ground surface 133, e.g., in between the conductive line 119 (connected to ground surface 133) and the capacitor side 117.

When a shunt element 240 is connected to the power supply unit 230, impedance of the capacitor 220 may be matched through the shunt element 240, to achieve resonance at a desired frequency. Thus, the other side 115 may not be connected to the ground surface 130. (That is, although the side 115 is shown connected to ground surface 130 in FIG. 2, this connection may be broken in an alternative embodiment for matching purposes.) For example, as the shunt element 240, an inductor element may be used."

In the example antenna apparatus of FIG. 2, feed connector 230 is of a type having a triangular shape. A transmission line (not shown) of the PCB 10 has a signal line and a ground point. The base of the connector 230 triangle is electrically connected to the signal line through a via or the like (not shown), and the tip of the triangle is connected to the ground point of the same potential as surface 133, as shown in FIG. 2. Auxiliary antenna 200 includes a radiating element 113, which can be in the form of a wire or conductive line, having a first end connected to the base of the triangle and an opposite end connected to the first side 115 of capacitor 220. The radiating element 113 may extend in approximately the lengthwise direction L of the portable device 105, so as to make a connection to the capacitor 220 at a lower location of the PCB 10. Shunt element 240 is shunted across the base of the triangle and the ground surface 133. Another conductive line 119 has a first end connected to the opposite side 117 of capacitor 220, and an opposite end 118 connected to the ground surface 133. The first side 115 of capacitor 220 is connected through a shorter conductive line to the ground surface 130 at a point 114.

Additional components 93, 94 and 95 of device 105, shown mounted on the top layer 17 of PCB 10, may be unrelated to the antenna apparatus, and may or may not affect the performance characteristics of the exemplary antenna apparatus.

Figure 3:
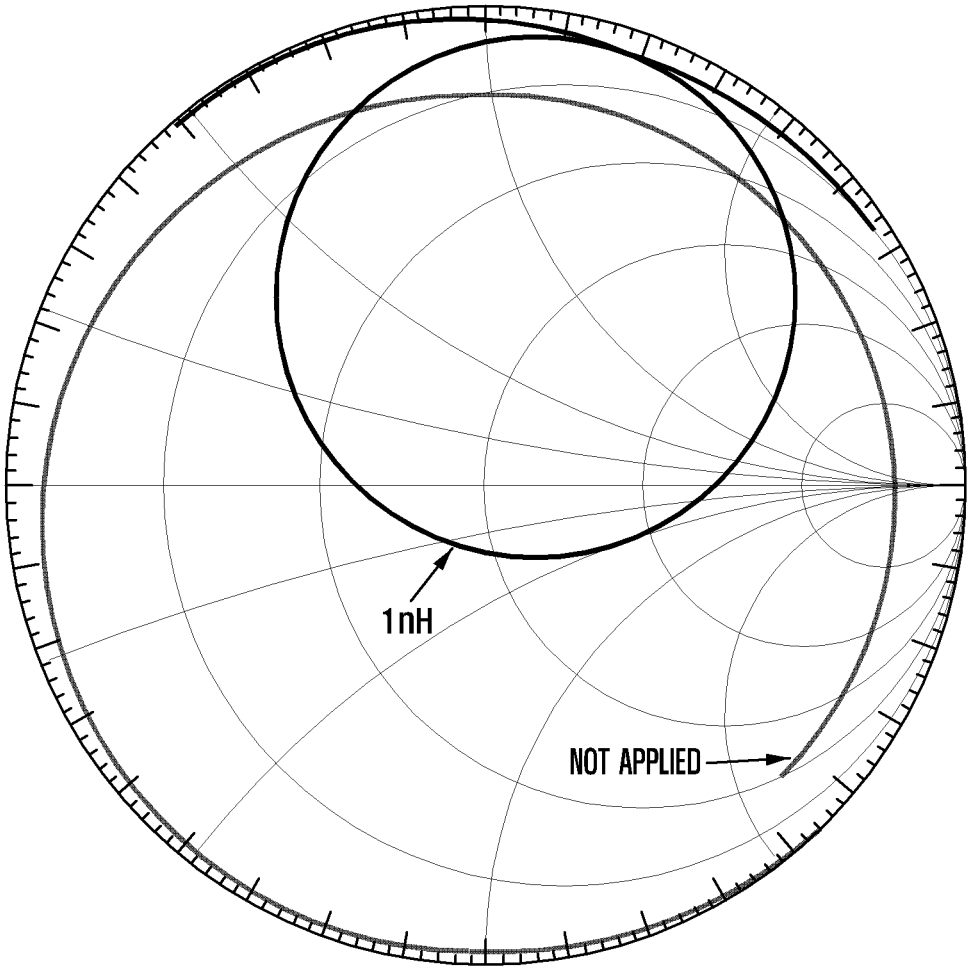
FIG. 3 is a diagram illustrating network analyzer data of an auxiliary antenna according to an exemplary embodiment of the present disclosure.

FIG. 3 illustrates network analyzer data of the auxiliary antenna 200 in which resonant impedance in a band represents a changed state by the shunt element 240 connected to the power supply unit 230.

The auxiliary antenna 200 can tune a resonant frequency of the auxiliary antenna 200 to a desired frequency range by adjusting capacitance of a plurality of capacitors 220.

In other words, a resonant frequency of a corresponding antenna can be changed according to a quantity of capacitance. For example, when a quantity of capacitance increases, a low level band resonant frequency of the auxiliary antenna 200 moves to a high end of the band. Thus, by adjusting a connection structure of a capacitor and a value of capacitance, a resonant frequency of a low level band may be adjusted.

Particularly, the auxiliary antenna 200 is disposed at an area adjacent to the main antenna 100 of the present exemplary embodiment and can embody a multi resonant antenna of a different frequency band.

Figure 4:
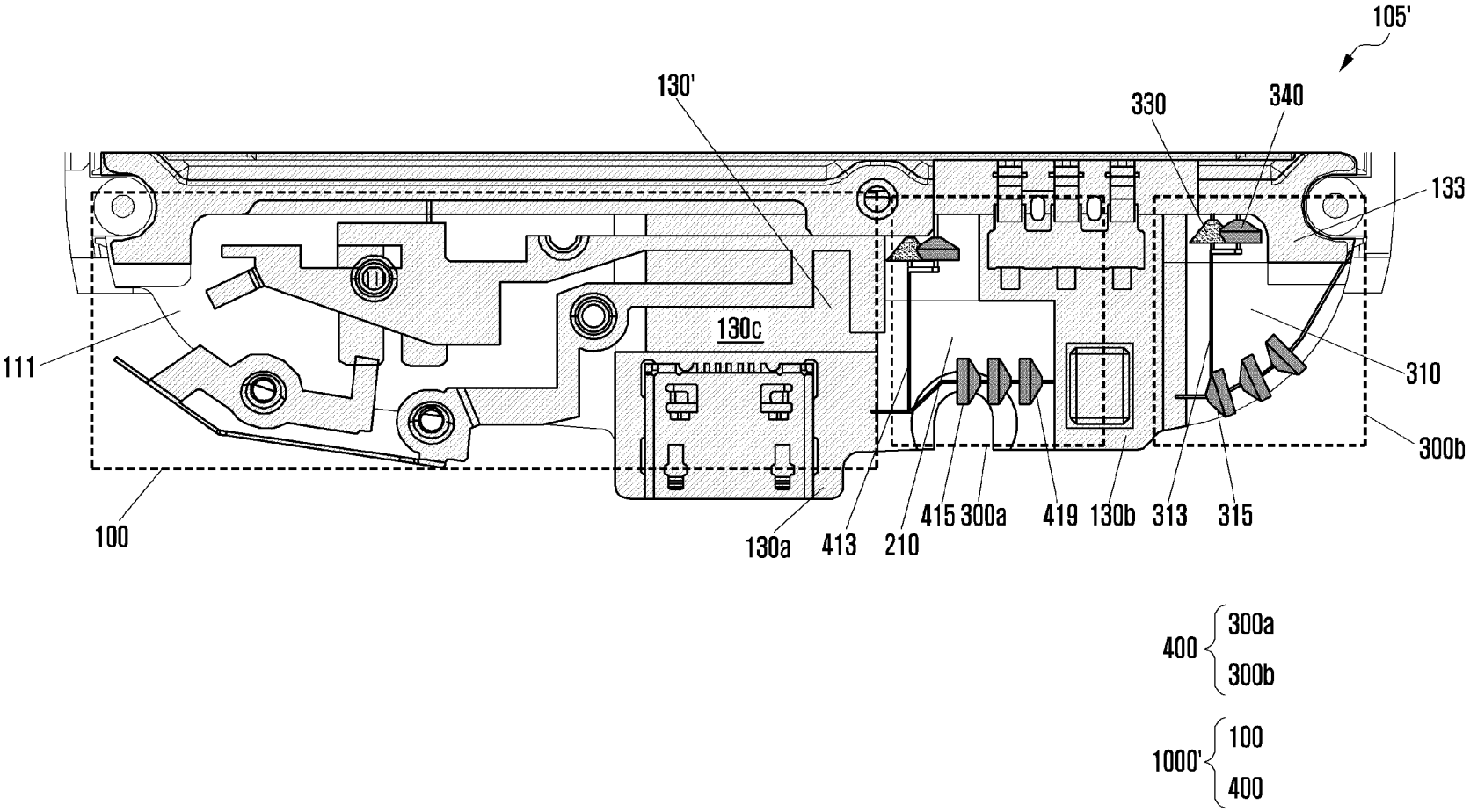
FIG. 4 is a plan view illustrating a multi resonant antenna as an auxiliary antenna according to an exemplary embodiment of the present disclosure.

FIG. 4 is a plan view diagram illustrating another exemplary embodiment of an antenna apparatus, 1000', in which an auxiliary antenna is embodied as a multi-resonant antenna. Antenna apparatus 1000' includes main antenna 100 and an auxiliary antenna 400. Auxiliary antenna 400 according to the present exemplary embodiment may be formed with a plurality of auxiliary antennas **300*a* and 300*b* disposed at a plurality of cut-out areas 210 and 310**, respectively.

Specifically, the first auxiliary antenna **300*a* disposed at the first cut-out area 210 and the second auxiliary antenna 300*b* disposed at the second cut-out area 310** are described.

The first auxiliary antenna **300*a* designed to resonate at a relatively low frequency band is disposed at the interior of the portable device 105', and a second auxiliary antenna 300*b*** which resonates at a relatively high frequency band is disposed at the circumferential edge side of the portable device.

Because an antenna designed for a low frequency band should be allocated to an area wider than that of a higher frequency band antenna, it is preferable that the second auxiliary antenna **300*b* of a high frequency band is disposed at the circumferential edge side of the portable device, and the first auxiliary antenna 300*a*** of a low frequency band is disposed toward the interior of the portable device.

A range of capacitors constituting the first auxiliary antenna **300*a* and the second auxiliary antenna 300*b*** may be formed to approximately 0.7 p-30 p, and in this case, a frequency band may be in a range of a low frequency band of 400 MHz to a high frequency band of 2G or more.

In the exemplary embodiment of FIG. 4, the second auxiliary antenna **300*b* is the same or similar in structure to the auxiliary antenna 200 of FIG. 2, thus redundant discussion thereof is omitted. Auxiliary antenna 300*b* includes an RF feed connector 330, shunt element 340 and radiator element 130***b* with the same or similar functions as in antenna 200. The first auxiliary antenna 300*a* may similarly include an RF feed connector and shunt element as shown, a radiator 413 connected between the feed connector and a first side 415 of at least one capacitor (three capacitors in series are exemplified). An opposite side 419 of the capacitor bank is connected to a ground surface 130*b*. Note that the antenna apparatus 1000' includes a ground surface 130' which differs from the ground surface 130 of FIG. 2 by omitting a central section by virtue of the cut-out 210. The ground surface 130' is considered to include three sections 130*a*, 130*b* and 130*c*, where section 130*c* is an additional section providing a ground connection for the right side portion of antenna 100. Section 130*b* separates the auxiliary antennas 300*a*, 300*b*. The first side 315 of the capacitor of antenna 300*b* is connected to the right hand side of ground section 130*b*. The second side 419 of the capacitor of antenna 300*a* is connected to the left hand side of section 130*b*. The first side 415 of the capacitor of antenna 300*a* is connected to ground section 130*a* through at least one short conductive line that also connects to the opposite end of radiator 413.

In the first auxiliary antenna 300*a* and the second auxiliary antenna 300*b*, because radiation is performed through the ground surface 130*b* or 133 enclosing each cut-out area, even if the first auxiliary antenna 300*a* and the second auxiliary antenna 300*b* are adjacently positioned, radiation interference between these two antennas can be minimized. In this case, isolation of the first auxiliary antenna 300*a* and the second auxiliary antenna 300*b* may be about −13 to −15 dB.

In this way, when embodying a multi resonant antenna using a capacitor as in the auxiliary antenna according to the present exemplary embodiment, a spatial restriction is not large and an auxiliary antenna can be additionally disposed at a periphery of the main antenna 100, which is a PCB type antenna, whereby space can be effectively used.

FIGS. 5 to 8 are plan views illustrating example structures of a multi resonant antenna according additional exemplary embodiments of the present disclosure.

Figure 5:
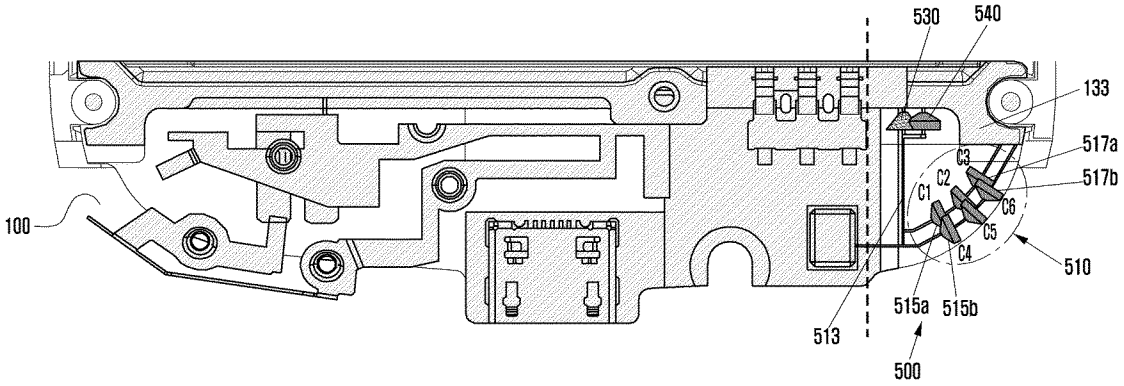
FIG. 5 is a plan view illustrating a structure of a multi resonant antenna according to another exemplary embodiment of the present disclosure.

FIG. 5 illustrates an auxiliary antenna 500 in which a resonant frequency is determined by a plurality of capacitors 510 connected in a rail structure.

The capacitor 510 of a rail structure is disposed at a cut-out area formed in a portion of an uppermost level metal plating layer of the PCB. Capacitor 510 receives RF signal power from a power supply connector 530 which may be the same or similar as RF feed connector 130 described above; and a shunt element 540 may be connected in parallel across the signal line of connector 530 and ground surface 133. A first end of a radiating element 513 is connected to the signal line of connector 530. A pair of first ends 515*a*, 515*b* of the capacitor 510 is connected to the opposite end of radiating element 513. A pair of second ends 517*a*, 517*b* of the capacitor 510 may be connected to a ground surface 133.

The capacitor 510 has different capacitances and is formed with a plurality of capacitors C1-C6 connected in parallel.

For example, the capacitor 510 is formed with a first capacitor group C1, C2, and C3 and a second capacitor group C4, C5, and C6 connected in parallel. It is preferable that capacitances of the first capacitor group C1, C2, and C3 and the second capacitor group C4, C5, and C6 are different.

A plurality of capacitors C1, C2, and C3 constituting the first capacitor group are connected in series, and capacitances of each of the capacitors C1, C2, and C3 may be the same or different.

A plurality of capacitors C4, C5, and C6 constituting the second capacitor group are connected in series, and capacitances of each of the capacitors C4, C5, and C6 may be the same or different.

For example, the first capacitor group C1, C2, and C3 may be provided to embody a resonant frequency of a low frequency band of the auxiliary antenna 500, and the second capacitor group C4, C5, and C6 may be provided to embody a resonant frequency of a high frequency band of the auxiliary antenna 500.

In this way, by a capacitor of a rail structure, i.e., a connection of a parallel structure of the first capacitor group and the second capacitor group having different capacitance, the auxiliary antenna 500 may become a multi resonant antenna having different resonant frequencies.

Figure 6:
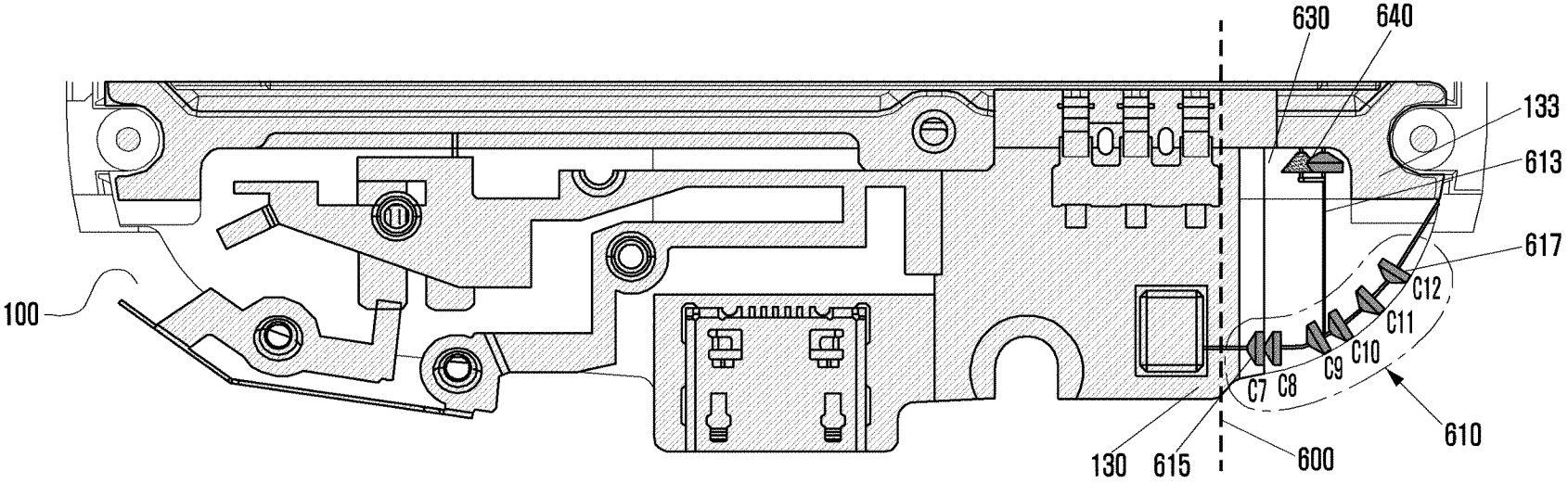
FIG. 6 is a plan view illustrating a structure of a multi resonant antenna according to another exemplary embodiment of the present disclosure.

FIG. 6 illustrates an auxiliary antenna 600 in which a resonant frequency is determined by a plurality of capacitors 610 connected in parallel by a radiator element 613 of a T structure.

The plurality of capacitors 610 are disposed at a cut-out area formed in a portion of an uppermost level metal plating layer of the PCB. The plurality of capacitors 610 receive the supply of power from an RF feed connector 630 which may be connected in parallel with a shunt element 640. One end 615 of the plurality of capacitors 610 may be connected to the ground surface 130, while the other end 617 is connected to the ground surface 133.

The plurality of capacitors 610 have different capacitances and are formed with capacitors C7-C12 connected in parallel. For example, the plurality of capacitors 610 may be formed with a third capacitor group C7, C8, and C9 and a fourth capacitor group C10, C11, and C12 disposed at the metal pattern 613 of a T structure.

Because a current is divided by the radiator element 613 of a T structure connected between the third capacitor group C7, C8, and C9 and the fourth capacitor group C10, C11, and C12 from the RF feed 630, the third capacitor group C7, C8, and C9 and the fourth capacitor group C10, C11, and C12 become a structure connected in parallel.

It is preferable that capacitances of the third capacitor group and the fourth capacitor group are differently formed.

A plurality of capacitors C7, C8, and C9 constituting the third capacitor group may be connected in series, and capacitances of each of the capacitors C7, C8, and C9 may be the same or different.

A plurality of capacitors C10, C11, and C12 constituting the fourth capacitor group may be connected in series, and capacitances of each of the capacitors C10, C11, and C12 may be the same or different.

For example, the third capacitor group may be provided to embody a resonant frequency of a low frequency band of the auxiliary antenna 600, and the fourth capacitor group may be provided to embody a resonant frequency of a high frequency band of the auxiliary antenna 600.

In this way, by the third capacitor group and the fourth capacitor group connected in parallel by a metal pattern of a T structure and having different capacitances, the auxiliary antenna 600 may become a multi resonant antenna having different resonant frequencies.

Figure 7:
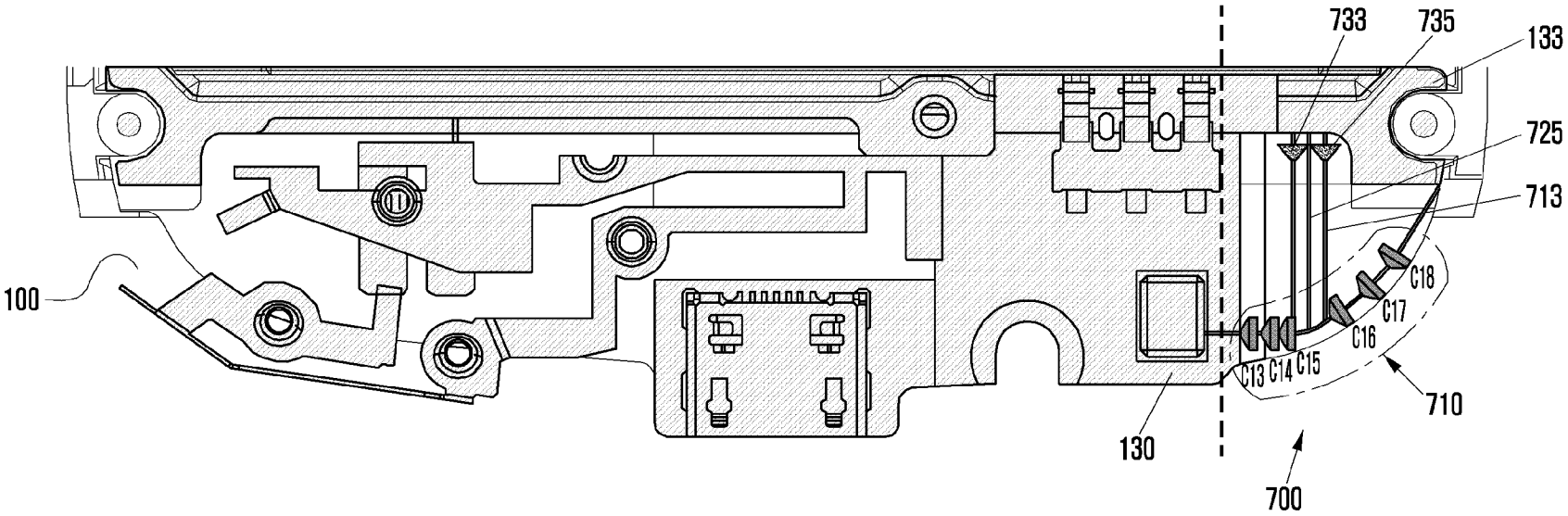
FIG. 7 is a plan view illustrating a structure of a multi resonant antenna according to another exemplary embodiment of the present disclosure.

FIG. 7 illustrates an auxiliary antenna 700 in which a resonant frequency is determined by a plurality of capacitors 710 connected in parallel by a metal pattern 713 of a first modified T structure.

The plurality of capacitors 710 are disposed at a cut-out area formed in a portion of a uppermost level metal plating layer of the PCB and include a fifth capacitor group C13, C14, and C15 and a sixth capacitor group C16, C17, and C18 connected in parallel by the metal pattern 713 of a first modified T structure.

The fifth capacitor group and the sixth capacitor group supply power by different RF feeds 733 and 735 by the radiator element 713 of the first modified T structure, but are connected in parallel by sharing a ground line 725.

That is, the fifth capacitor group and the sixth capacitor group are connected in parallel by a connection of a ground line shared by the commonly connected metal pattern of a first modified T structure and another power supply line.

The fifth capacitor group and the sixth capacitor group may supply power with different signal power levels by the separated power supply units 533 and 535 or may supply power with the same signal power level.

It is preferable that capacitances of the fifth capacitor group and the sixth capacitor group are differently formed.

A plurality of capacitors C13, C14, and C15 constituting the fifth capacitor group may be connected in series, and capacitance of each of the capacitors C13, C14, and C15 may be the same or different.

A plurality of capacitors C16, C17, and C18 constituting the sixth capacitor group may be connected in series, and capacitances of each of the capacitors C16, C17, and C18 may be the same or different.

For example, the fifth capacitor group may be provided to embody a resonant frequency of a low frequency band of the auxiliary antenna 600, and the sixth capacitor group may be provided to embody a resonant frequency of a high frequency band of the auxiliary antenna 600.

In this way, the auxiliary antenna 700 may become a multi resonant antenna having different resonant frequencies by the fifth capacitor group and the sixth capacitor group that supply power by the radiator element 713 of a first modified T structure and that share a ground line.

The separated power supply connectors 733 and 735 may be replaced with a single connector that divides and applies a signal power supplied from a power supply source (not shown) of the PCB to the fifth capacitor group and the sixth capacitor group.

Figure 8:
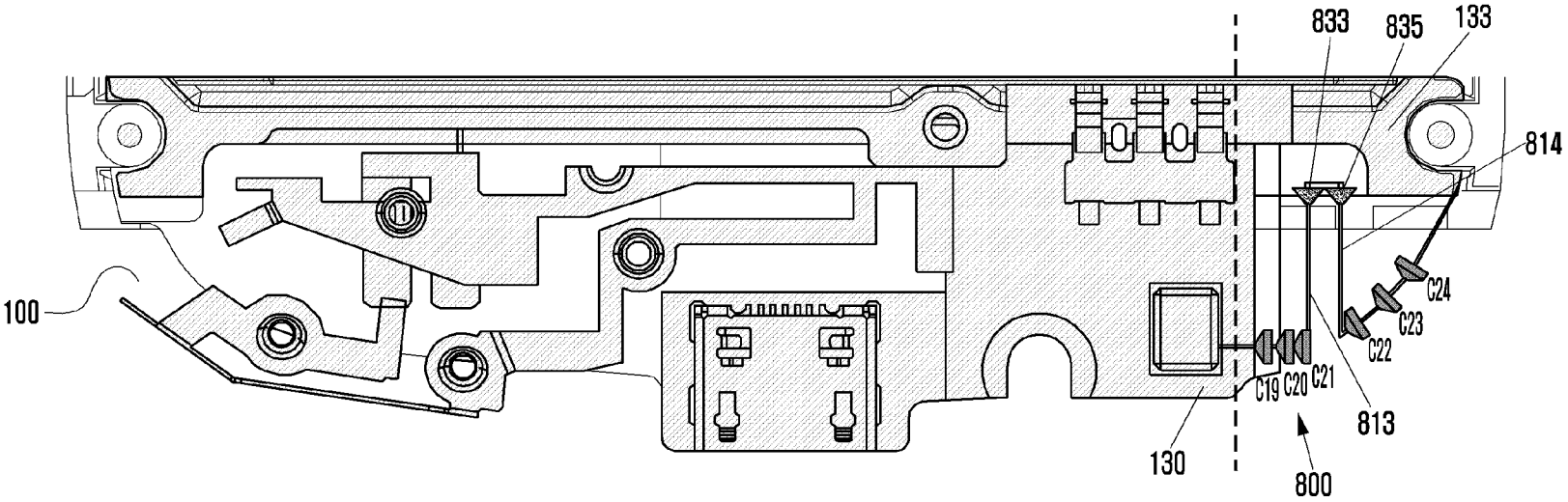
FIG. 8 is a diagram illustrating a structure of a multi resonant antenna according to another exemplary embodiment of the present disclosure.

FIG. 8 illustrates an auxiliary antenna 800 in which a resonant frequency is determined by a plurality of capacitors 810 connected in parallel by radiator elements 813 and 814 of a second modified T structure.

The plurality of capacitors 810 are disposed in a cut-out area formed in a portion of a uppermost level metal plating layer of the PCB and include a seventh capacitor group C19, C20, and C21 and an eighth capacitor group C22, C23, and C24 connected by the radiators 813 and 814 of a second modified T structure.

The seventh capacitor group and the eighth capacitor group supply power by different power supply feeds 833 and 835 by the radiators 813 and 814, respectively, of the second modified T structure, and are connected to a ground surfaces 130 and 133, respectively.

That is, first ends of the seventh capacitor group and the eighth capacitor group are each connected to different power supply lines, and the opposite (second) ends thereof are each connected to the ground surface 130 or 133.

The seventh capacitor group and the eighth capacitor group may supply power with different signal power levels or may supply power with the same power levels.

It is preferable that capacitances of the seventh capacitor group and the eighth capacitor group are differently formed.

A plurality of capacitors C19, C20, and C21 constituting the seventh capacitor group may be connected in series, and capacitances of each of the capacitors C19, C20, and C21 may be the same or different.

A plurality of capacitors constituting the eighth capacitor group may be connected in series, and capacitances of each of capacitors C22, C23, and C24 may be the same or different.

For example, the seventh capacitor group may be provided to embody a resonant frequency of a low frequency band of an auxiliary antenna 800, and the eighth capacitor group may be provided to embody a resonant frequency of a high frequency band of the auxiliary antenna 800.

In this way, the auxiliary antenna 800 may become a multi resonant antenna having different resonant frequencies by means of the seventh capacitor group and the eighth capacitor group, which supply power by radiator elements 813 and 814 of a second modified T structure.

The separated power supply connectors 733 and 735 may be replaced with a combined connector that divides and applies signal power supplied from a power supply source (not shown) of the PCB to the seventh and eighth capacitor groups.

Figure 9:
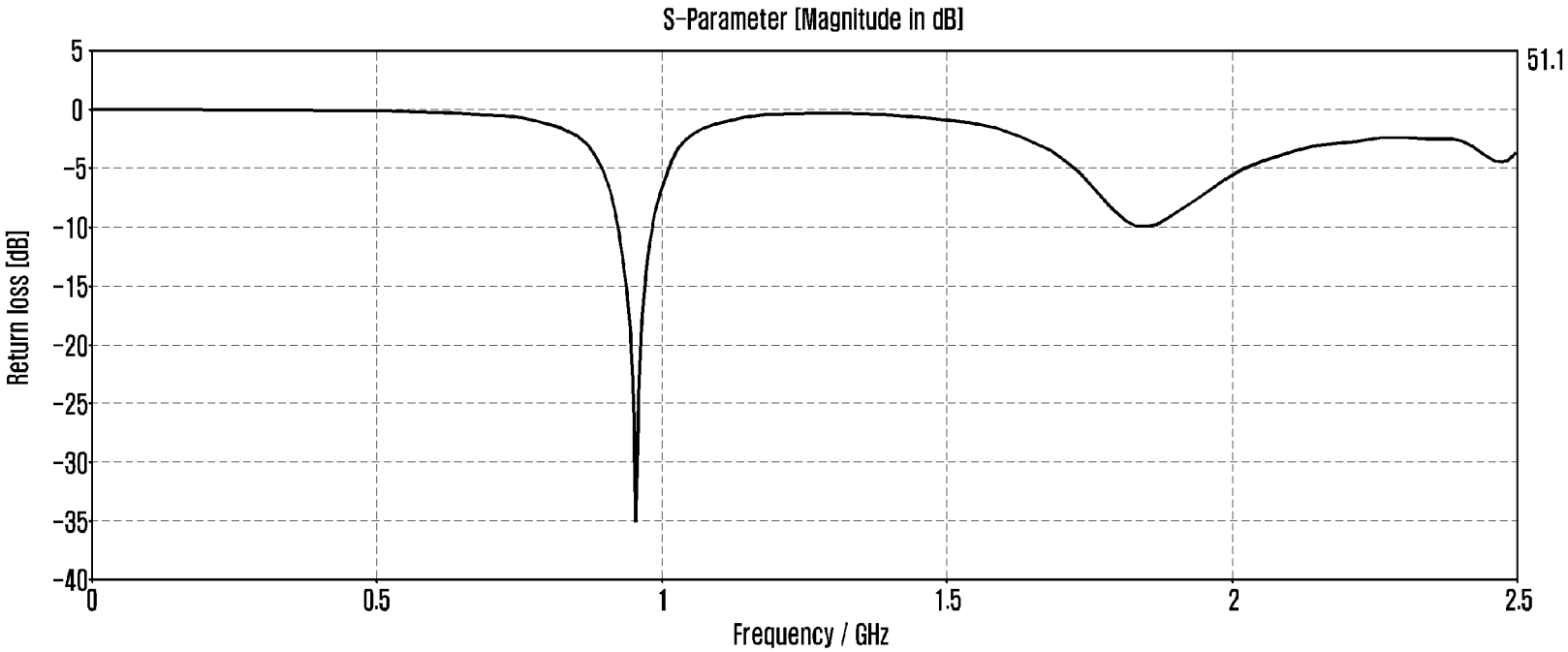
FIG. 9 and FIG. 10 are graphs illustrating a simulation result according to an exemplary embodiment of the present disclosure.

FIG. 9 illustrates a measurement result of return (reflection) loss dB using a network analyzer for the auxiliary antenna 200 that embodies a multi resonant frequency via the at least one capacitor 220 of FIG. 2. As can be seen from a measured result, the auxiliary antenna 200 according to the present exemplary embodiment may achieve a bandwidth of −5 dB (bandwidth in which return loss is at least 5 dB) embodies a wideband characteristic in dual bands over about 0.9 GHz-2 GHz.

Figure 10:
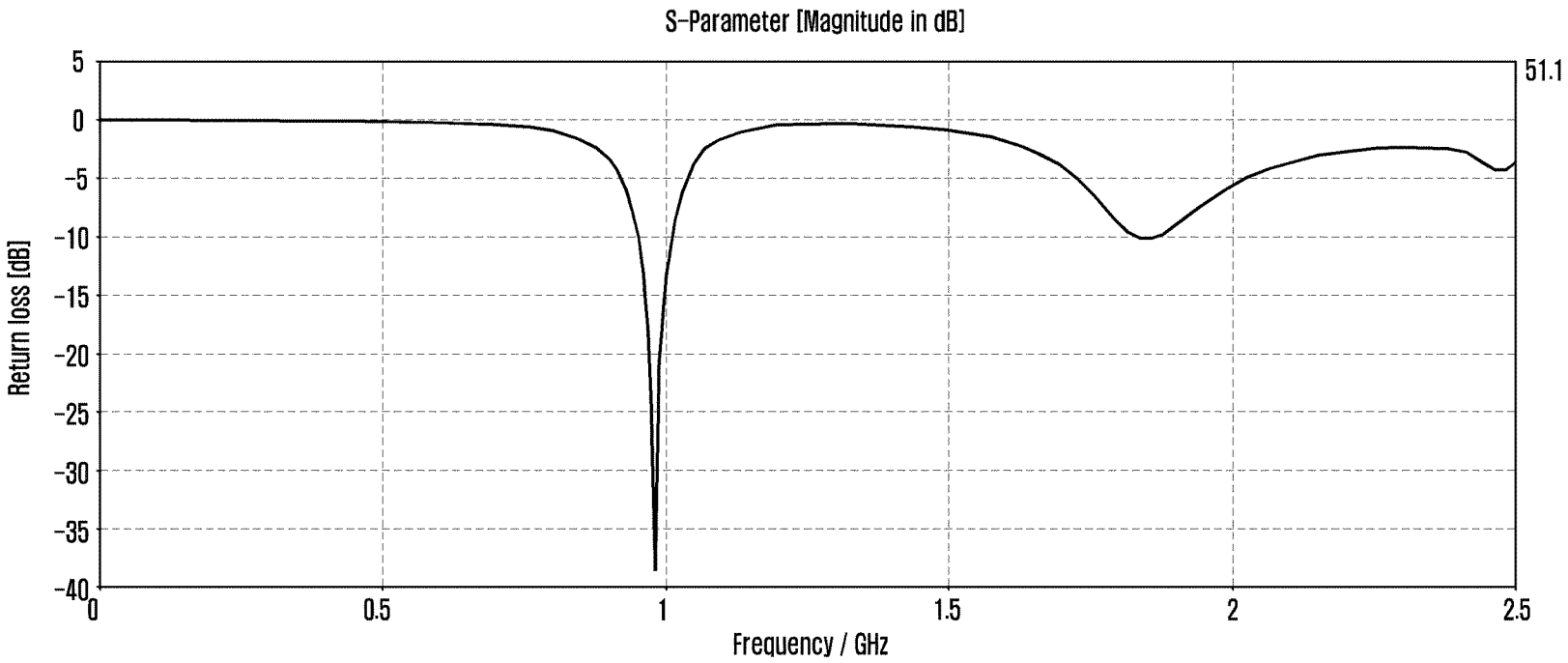

FIG. 10 illustrates a result that measures return loss dB using a network analyzer in the auxiliary antenna 500 that embodies a multi resonant frequency by the plurality of capacitors 510 connected in the rail structure of FIG. 5. As can be seen from a measured result, the auxiliary antenna 500 according to the present exemplary embodiment may achieve a bandwidth of −5 dB over a wideband characteristic from about 0.9 GHz-2.1 GHz.

An auxiliary antenna of the present exemplary embodiment can obtain a resonant frequency desired by a user/portable device designer by adjusting capacitance via tuning a connection structure of the at least one capacitor using the above-described principles.

When disposing a multi antenna within a portable device having a small and narrow area, a configuration and disposition technology for a multi resonance of an auxiliary antenna adjacent to a main antenna of the present disclosure can enhance efficiency and allow for an antenna operating in various frequency bands.

As described above, in an antenna and a portable device having the same according to the present disclosure, by adjacently disposing an antenna in which a radiation principle and a structure are different, while preventing a distortion phenomenon of an antenna characteristic due to interference between antennas, mounting space of a multiple band antenna can be secured.

Further, according to the present disclosure, by adjusting capacitance of at least one capacitor, a resonant frequency of an antenna can be tuned to a desired frequency band.

Although exemplary embodiments of the present disclosure have been described in detail hereinabove, it should be clearly understood that many variations and modifications of the basic inventive concepts herein described, which may appear to those skilled in the art, will still fall within the spirit and scope of the exemplary embodiments of the present disclosure as defined in the appended claims.

What is claimed is:

1. An antenna apparatus provided in a portable device, comprising:

a main antenna having a first radiator pattern;

a ground surface adjacent to the main antenna; and an auxiliary antenna separated from the main antenna by a ground surface and disposed entirely within a cut-out area of a printed circuit board (PCB) adjacent to the ground surface, wherein the auxiliary antenna radiates through the ground surface, wherein the auxiliary antenna comprises:

a radiator element having a first end connected to an RF feed point and a second opposite end;

a first group of series connected capacitors, the first group having a first side connected to the second end of the radiator element and a second side connected to a first ground surface location, and a second group of series connected capacitors, the second group having a first side connected to the second end of the radiator element and a second side connected to the first ground surface location, and wherein a capacitance of the first group of capacitors differs from the capacitance of the second group of capacitors, such that the auxiliary antenna resonates at multiple resonant frequencies through the first and second group of capacitors; and the second end of the radiator element is connected to the ground surface at a different location than the first ground surface location.

2. The antenna apparatus of claim 1, wherein the main antenna is a PIFA antenna having a point thereof connected to the ground surface.

3. The antenna apparatus of claim 1, wherein the main antenna resonates at a resonant frequency different from the multiple resonant frequencies at which the auxiliary antenna resonates.

4. The antenna apparatus of claim 1, wherein the main antenna having the first radiator pattern is configured for operation at a third resonant frequency different from the multiple resonant frequencies at which the auxiliary antenna radiates, the radiator pattern comprising a first portion composed of metal of an uppermost level metal layer of the PCB and a second portion composed of metal of a lower metal layer of the PCB separated from the uppermost level layer by a dielectric layer, and electrically connected to the first portion through a via hole in the dielectric layer.

5. The antenna apparatus of claim 1, wherein the auxiliary antenna further comprises a shunt element for impedance matching, the shunt element being connected between a signal line of a power supply connector and the ground surface.

6. The antenna apparatus of claim 1, wherein the main antenna and the auxiliary antenna are each disposed at a lower end of the PCB within the portable device.

7. The antenna apparatus of claim 1, wherein the main antenna is at least one of a planar inverted F (PIFA) antenna, an antenna formed in a Z-axis direction by connection of a PCB layer of a stacked structure and a via hole, an antenna plated by a metal pattern in a carrier, an antenna generated by rear fusion-bonding, a FPCB antenna, and a laser direct structuring (LDS) antenna.

8. A portable device comprising an antenna apparatus, comprising:

a printed circuit board (PCB) comprising first and second cut-out areas formed adjacent to an uppermost level metal layer, and at least one lower metal layer separated from the uppermost layer by a dielectric layer;

a main antenna disposed at the first cut-out area, having a first radiator configured for operation at a first resonant frequency, the first radiator having a first portion composed of metal of the uppermost level metal layer and a second portion composed of metal of the at least one lower metal layer; and an auxiliary antenna disposed entirely within the second cut-out area, and configured to resonate at each of second and third resonant frequencies, the auxiliary antenna radiating through a ground surface at a periphery of the second cut-out area, wherein the auxiliary antenna comprises first and second radiator elements connected in parallel by a connection of different power supply lines and a ground line shared by a metal pattern of a T structure commonly connected and comprises a first capacitor group and a second capacitor group having different capacitances which cause the auxiliary antenna to resonate at each of the second and third resonant frequencies, respectively, and wherein the ground line is disposed in between an input portion of the first radiator element and an input portion of the second radiator element, and runs substantially parallel to each of the input portions of the first and second radiator elements.

9. The portable device of claim 8, wherein the different power supply lines supply power to a corresponding capacitor group by a common connector that divides and applies signal power supplied from a power supply source of the PCB.

10. A portable device, comprising:

a printed circuit board (PCB) having a ground surface;

a main antenna having a first radiator pattern; and an auxiliary antenna separated from the main antenna by the ground surface and disposed entirely within a cut-out area of the PCB adjacent to the ground surface, wherein the auxiliary antenna radiates through the ground surface, wherein the auxiliary antenna comprises:

a radiator element having a first end connected to an RF feed point and a second opposite end;

a first group of series connected capacitors, the first group having a first side connected to the second end of the radiator element and a second side connected to a first ground surface location, and a second group of series connected capacitors, the second group having a first side connected to the second end of the radiator element and a second side connected to the first ground surface location, and wherein a capacitance of the first group of capacitors differs from a capacitance of the second group of capacitors, such that the auxiliary antenna resonates at multiple resonant frequencies through the first and second group of capacitors; and the second end of the radiator element is connected to the ground surface at a different location than the first ground surface location.

* * * * *